United States Patent [19]

Brumley et al.

[11] 4,124,663

[45] Nov. 7, 1978

[54] CONTINUOUS PROCESS FOR PELLETING EXPLOSIVE COMPOSITIONS

[75] Inventors: Charles D. Brumley, Greeneville; Alex Fancher, Jr.; Paul L. Lee, both of Kingsport, all of Tenn.

[73] Assignee: The United States of America as represented by the Secretary of the Army, Washington, D.C.

[21] Appl. No.: 840,337

[22] Filed: Oct. 7, 1977

[51] Int. Cl.[2] ..... C06B 21/00

[52] U.S. Cl. ..... 264/3 D; 149/18; 149/109.6; 264/3 C

[58] Field of Search ..... 264/3 C–3 E; 149/2, 109.6, 18

[56] References Cited

U.S. PATENT DOCUMENTS

| | | | |
|---|---|---|---|
| 2,774,660 | 12/1956 | Cook et al. | 264/3 D |
| 3,070,837 | 1/1963 | Loertscher et al. | 264/3 D |
| 3,120,026 | 2/1964 | Russell et al. | 264/3D |
| 3,600,477 | 8/1971 | Friedel et al. | 264/3 C |
| 3,961,106 | 6/1976 | Heytmeijer et al. | 149/2 |

FOREIGN PATENT DOCUMENTS 755,695 8/1956 United Kingdom.

*Primary Examiner*—Edward A. Miller

*Attorney, Agent, or Firm*—Nathan Edelberg; Harold H. Card, Jr.; A. Victor Erkkila

[57] ABSTRACT

Finely divided pellets or granules are formed from a molten explosive composition by a combination of spray chilling and prilling techniques, which comprises atomizing the molten explosive composition in a high velocity stream of an inert gas such as air and allowing the atomized droplets to fall through a tower countercurrent to a stream of an inert gas to cool the droplets to form solid pellets. The process is advantageously employed for producing meltable explosive materials, e.g., Composition B, in the form of free flowing spherical pellets of high density and uniform composition.

6 Claims, 3 Drawing Figures

CONTINUOUS PROCESS FOR PELLETING EXPLOSIVE COMPOSITIONS

GOVERNMENTAL INTEREST

The invention described herein was made under a contract with the Government and may be manufactured, used or licensed by or for the Government for Governmental purposes without the payment to us of any royalties thereon.

BACKGROUND OF THE INVENTION — PRIOR ART STATEMENT

Castable or meltable explosives and explosive compositions, such as TNT, Composition B, cyclotols and octols, as well as melt-mix compositions of TNT with tetryl, ammonium nitrate, picric acid, PETN, etc., are put into a flake or chip form by casting the molten material on a suitable device. A number of methods are known for producing granules or pellets from a molten explosive composition, such as TNT, and suspensions of solid high melting explosives, such as RDX (1,3,5-trinitro-1,3,5-triazacyclohexane) and HMX (1,3,5,7-tetranitro-1,3,5,7-tetraazacyclooctane) in the molten explosive, such as Composition B. One method comprises melting the explosive composition in a hot water slurry under vigorous agitation and cooling the slurry below the solidification temperature of the explosive to effect granulation. British Pat. No. 755,695 discloses the production of essentially spherical pellets by flowing molten TNT through capillary tubes into a water bath heated at the top to above the melting point of the TNT, wherein the molten TNT droplets sink into the cooler zone and soldify into free-flowing dense pellets of 1/16 to 3/16 in. diameter. USP 3600477 discloses a continuous process for granulating explosive compositions, such a TNT and Composition B, by introducing a stream of the molten explosive composition into a granulating vessel and atomizing the molten composition by dropping it together with a stream of water or other suitable fluid, including a gas, e.g., air, onto the surface of a rotating disk, whereby the explosive composition if flung against the walls of the granulating vessel together with the water and the granulated explosive and water flow from the bottom of the vessel to a filter for separation of the granules from the water. Granules produced by this type of process are very irregular and have a low bulk density.

BRIEF SUMMARY OF THE INVENTION

An object of the present invention is to provide a continuous process for producing free-flowing pellets from a molten explosive.

Another object of the invention is to provide a method, which produces the granules or pellets in a dry state requiring no further processing to remove water or other objectionable liquids, and also allows for some degree of control of the particle size of the pellet.

Another object is to provide a continuous process for producing free-flowing pellets of high density and uniform composition from a molten explosive containing a suspension of solid particles of a relatively high melting explosive, such as Composition B.

A further object is to provide a process for pelleting molten explosives with reduced pollution abatement requirements.

Other objects will become apparent as the invention is further described.

It has been found that the foregoing objects can be achieved according to the process of the present invention, which consists of a combination of prilling and spray chilling techniques, wherein a stream of the molten explosive is atomized in a high velocity stream of air or other inert gas and the atomized droplets are dropped through a vertical tower against a countercurrent stream of air or inert gas to solidify the droplets into pellets.

DETAILED DESCRIPTION OF THE INVENTION

Figure 1:
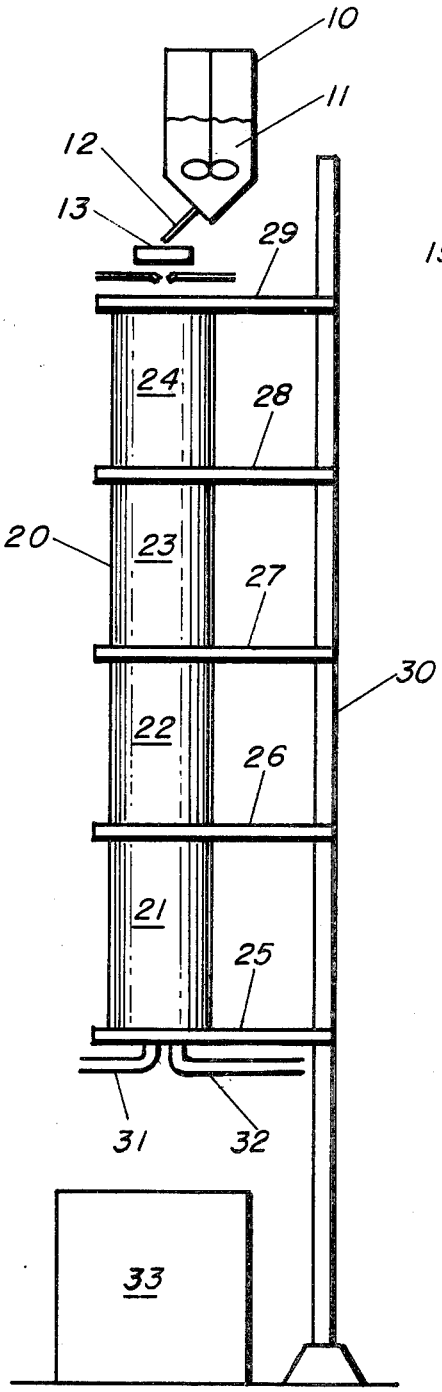
FIG. 1 shows an apparatus suitable for pelleting molten explosive compositions according to the process of the present invention.
Figure 2:
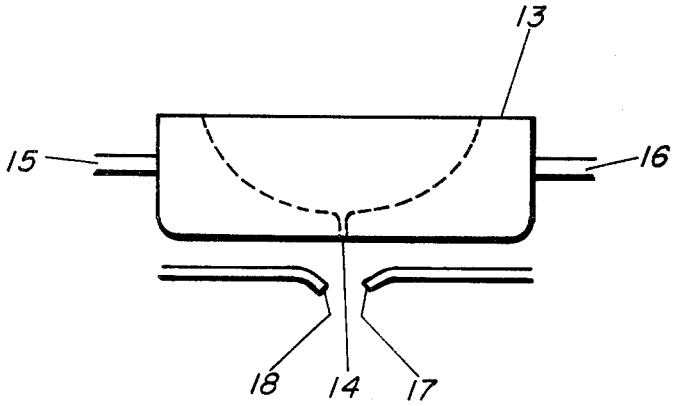
FIG. 2 is a side view of a jacketed drop pot and an arrangement of airjets for atomizing the molten explosive in the apparatus shown in FIG. 1.
Figure 3:
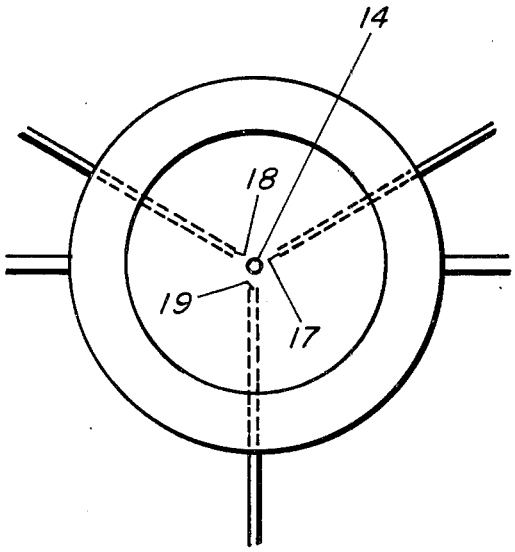
FIG. 3 is a top view of the drop pot and airjets shown in FIG. 2.

With reference to the drawings, wherein like numerals refer to like parts, Composition B (a mixture of 59.5 parts RDX, 39.5 parts TNT and 1 part desensitizing wax — the parts are by weight) was melted in an agitated, hot wate jacketed still (10) and maintained at approximately 84° C. with good agitation during the process to produce a homogeneous mixture. The molten composition (11) was run from the still via outlet 12 to a hot water jacketed drop pot (13), having an ⅛ dia. orifice (14) at the bottom, wherein it was maintained at approximately 84° C. by circulation of hot water through the jacket via inlet 15 and outlet 16. The molten composition was added to the drop pot in increments so that segregation was minimized. (In larger scale operations the drop pot is preferably agitated). Symmetrically positioned below the orifice (14) were three high velocity air jets 17, 18, 19, which were focused on the stream of molten Composition B, flowing by gravity from the drop pot orifice (14). The stream of molten Composition B was disintegrated into atomized droplets by the force of the high velocity air streams from the jets, which were directed at a slightly downward angle to direct the atomized droplets into the top of a cylindrical tower (20) of 24 feet height and 1 foot I.D., located just below the jets. The tower was fabricated from four superimposed fiber cylinders (21,22,23,23) supported by brackets (25,26,27,28,29) attached to supporting column (30). The atomized droplets were allowed to drop through the tower against a countercurrent stream of air at ambient temperature introduced into the bottom of the tower at the rate of 20 cubic feet per minute via two inlets (31,32). The countercurrent stream of air from the bottom of the tower solidified the atomized droplets of Composition B into pellets, which dropped from the bottom of the tower into a receptacle (33). The pellets thus obtained, as shown in photomicrographs, were very smooth and generally spherical with a median diameter of 600 to 700 microns, and possessed Bechtel bulk density values ranging from 0.97 to 1.04 g/ml. The minimum Bechtel bulk density specification for Granular Composition B is 0.90 g/ml. In comparison, the Bechtel bulk density values of Granular Composition B made by the water slurry process averages approximately 0.89 g/ml. The sensitivity of the Composition B product thus produced was comparable to the product produced by the water process. Surprisingly, no static electricity was detected with a static meter in any part of the operation except in the air flow upward through the tower, which was less than the amount measured on a polyethylene drum liner before it was rubbed. By employing a tower constructed of a conductive material the static electricity can be eliminated.

The pellet size can be varied by changing the air supply to the jets, i.e., by varying the ratio of the volume and velocity of the air stream or streams employed for atomizing to the volume of molten explosive composition to be atomized. In the foregoing apparatus the maximum pellet size was limited to approximately 700 microns due to the limited tower height and restricted air supply into the bottom of the tower which did not allow larger droplets to solidify in the tower. The high velocity stream of air or other inert gas, employed at ordinary temperature or at below the solidification temperature of the molten explosive, atomizes as well as effects a partial cooling of the molten material, which is then solidified by the countercurrent stream of cooling gas in the tower. The tower dimensions, temperature and volume of the cooling gas can be adjusted to provide the cooling required to solidify the atomized droplets of explosive composition in the tower. The volume of the cooling gas introduced into the bottom of the cooling tower can be regulated so that it is vented at the top of the tower with very little, if any, fine granules of the explosive being blown out of the top of the tower, thus requiring no special ventilation system. A cyclone precipitator can be employed to remove such particles, if desired.

Exceptionally good results are obtained by introducing the stream of molten explosive material into the focus of a plurality of high velocity jets of inert gas positioned around said stream, preferably so that the jet streams are directed slightly downward into the tower, as illustrated above. In this manner, the jet nozzles do not become coated or clogged with solidified material and the thin stream of molten explosive can be instantly disintegrated into extremely small droplets, which are solidified by the countercurrent cooling gas into smooth pellets of generally spherical shape possessing unusually high bulk density (the smoothness and size of the granule are the most determinative factors of bulk density). As noted above, it was previously known to produce pellets or granules from a molten explosive composition by continuously introducing a stream of the molten explosive through capillary tubes into a body of cooling wate, or into a granulating vessel and atomizing the molten explosive by dropping it along with a stream of water or other suitable fluid onto the surface of a rotating disk, whereby the explosive and water or fluid are flung against the walls of the granulating vessel and the granulated explosive and water flow from the bottom of the vessel to a filter for separation of the granules from the water. We have found that in order to produce a pelletized product having an acceptable high bulk density, it is necessary to atomize the explosive, e.g., Composition B, in the molten state and solidify the droplets with a cooling gas without their coming in contact with something, such as a wall, to alter their spherical shape.

The process of the present invention provides a number of important advantages. It is simple to operate, start and stop, and well suited for large scale operation. The congealing tower capital costs are only about one quarter of the capital costs of the water slurry process. As compared with processes wherein water is employed in the pelleting or granulation operation, the present process provides superior control of the particle size and bulk density of the product; and in the case of explosive compositions containing TNT, it results in reduced pollution abatement problems, since no "red water" treatment is required. Further, the present process produces the pellets to the same or lower residual water content than the starting material, which obviates the need for further processing steps, such as drying. The present process is particularly advantageous for producing pellets of high density and uniform composition from molten explosive compositions containing a suspension of solid explosive particles e.g., RDX, in a molten explosive, e.g., TNT. Unless such suspensions are maintained under vigorous agitation, the solid particles tend to separate from the liquid phase, which results in pellets of non-uniform composition. This process may also be used on TNT by itself without the suspension of RDX as well as on other explosive chemical compounds which are stable at their melting point. The process is also usable on other TNT based castable explosive compositions, such as cyclotol (mixture of RDX and TNT), octol (mixture of HMX and TNT), amatol (mixture of ammonium nitrate and TNT), tetrytol (mixture of TNT and tetryl, i.e., 2,4,6-trinitrophenylmethylnitramine), tritonal (mixture of TNT and aluminum), baratol (mixture of barium nitrate and TNT), baronal (mixture of barium nitrate, aluminum and TNT), ednatol (mixture of ethylene dinitramine and TNT), HBX (mixture of RDX, TNT, aluminum, wax and calcium chloride), picratol (mixture of TNT and ammonium picrate), PTX (mixture of RDX, tetryl and TNT), etc.

The foregoing disclosure and drawings are merely illustrative of the principles of this invention and are not to be interpreted in a limiting sense. I wish it to be understood that I do not desire to be limited to the exact details of construction shown and described, because obvious modifications will occur to a person skilled in the art.

We claim:

1. A continuous process for preparing solid pellets from a molten explosive material, which comprises:

a. introducing a stream of the molten explosive material into a high velocity jet of inert gas to atomize said stream into finely divided liquid droplets;

b. allowing the liquid droplets to fall through a vertical tower;

c. introducing a current of an inert gas upwardly through the tower to cool said droplets to form solid pellets during their fall through said tower, and d. discharging said pellets from the bottom of said tower.

2. The process of claim 1, wherein the molten explosive material comprises a suspension of relatively high melting solid particles.

3. The process of claim 2, wherein the molten explosive is TNT.

4. The process of claim 3, wherein the solid particles include a relatively high melting explosive selected from the group consisting of 1,3,5-trinitro-1,3,5-triazacyclohexane, 1,3,5,7-tetranitro-1,3,5,7-tetraazacyclooctane, ammonium nitrate, barium nitrate, pentaerythritol tetranitrate, ammonium picrate, tetryl, ethylenedinitramine and mixtures thereof.

5. The process of claim 1, wherein the high velocity jet of inert gas is at a temperature below the solidification point of said molten explosive to effect partial cooling of said liquid droplets.

6. The process of claim 1, wherein the stream of molten explosive is introduced into the focus of a plurality of high velocity jets of inert gas positioned around said stream.

* * * * *